US006085891A

United States Patent [19]

Behle

[11] Patent Number: 6,085,891

[45] Date of Patent: Jul. 11, 2000

[54] PALLET BODY FOR MOVING PAVEMENTS

[75] Inventor: Fritz Behle, Sprockhövel, Germany

[73] Assignee: O&K Rolltreppen GmbH & Co., Hattingen, Germany

[21] Appl. No.: 09/011,541

[22] PCT Filed: Jun. 17, 1996

[86] PCT No.: PCT/EP96/02598

§ 371 Date: Jan. 14, 1998

§ 102(e) Date: Jan. 14, 1998

[87] PCT Pub. No.: WO97/03910

PCT Pub. Date: Feb. 6, 1997

[30] Foreign Application Priority Data

Jul. 15, 1995 [DE] Germany ..... 195 25 827

[51] Int. Cl.[7] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 3,096,725 | 7/1963 | Widmer . | |
| 3,247,947 | 4/1966 | Fox et al. . | |
| 5,072,821 | 12/1991 | Kruse et al. | 198/333 X |
| 5,595,278 | 1/1997 | Ostermeier et al. | 198/333 |
| 5,697,487 | 12/1997 | Engelke et al. | 198/333 |
| 5,810,148 | 9/1998 | Schoeneweiss | 198/333 |

FOREIGN PATENT DOCUMENTS

| | | | |
|---|---|---|---|
| 2553395 | 4/1985 | France . | |
| 1530022 | 9/1969 | Germany . | |
| 2248406 | 4/1974 | Germany . | |
| 3337611C2 | 5/1985 | Germany . | |
| 291388 | 12/1990 | Japan | 198/333 |
| 933203 | 8/1963 | United Kingdom . | |

OTHER PUBLICATIONS

OTIS, brochure "The Modern Way For People To Travel Horizontally", No Date Available.

OTIS, specification sheet, No Date Available.

*Primary Examiner*—James R. Bidwell

*Attorney, Agent, or Firm*—Venable; George H. Spencer; Catherine M. Voorhees

[57] ABSTRACT

A pallet body (1) consists of a stepboard (2) with toothed front and rear edges, linking eyes (7, 8) that receive and guide linking and/or driving elements (21) and stepboard supporting elements (9, 10) that receive and guide preceding and following pallet bodies equipped with corresponding linking elements. The linking eyes and stepboard supporting elements are mounted on the one hand under the stepboard, within its lateral edges, and project on the other hand over a predetermined distance beyond the front and rear edges.

7 Claims, 6 Drawing Sheets

PALLET BODY FOR MOVING PAVEMENTS

BACKGROUND OF THE INVENTION

1. Field of the Invention

The invention relates to a pallet body for travelators comprising a treadplate having toothed front and rear edges, connecting elements for receiving and guiding connecting and/or drive members as well as treadplate supporting elements for receiving and guiding leading and trailing pallet bodies includes corresponding components, the connecting elements being produced integrally with the treadplates and the treadplate supporting elements being arranged underneath and protruding beyond the front and rear edges of the treadplate by a specified distance.

2. Description of the Prior Art

DE-C 33 37 611 relates to a passenger and freight travelator system comprising an endless treadplate track having deflection in the horizontal axis, as well as either a free or roller carrying traction chain and treadplates including traction and tow pins which are arranged corner-near in the corresponding opposite position. The passenger and freight system can freely carry either rollers and the traction pins in addition to the traction chain and directly supports or comprises indirectly supporting, traction pins in traction chains mounted with idler rollers and bifurcated overclasping treadplate supporting elements which are secured by the tow pins. The traction and tow pins adaptable to the system in each case are replaceable for a treadplate which is the same irrespective of the system concerned and the treadplate rollers or bifurcated treadplate supporting elements of all treadplates are provided in-line with each other parallel to the treadplate track direction between the treadplate sidewalls and the inner links of the traction chain. In this travelator system it is an advantage that a pallet body can be put to use irrespective of the type of travelator concerned (department store/transportation travelator), the disadvantage being that the pallet body comprises a plurality of components which in the end do not result in an inconsiderable diversification of the pallet as a whole or of the travelator which ultimately translates into increased labor and related costs. On top of this each and every pallet body needs to be preassembled (shop assembly) before it can be incorporated (in site assembly) in the corresponding travelator. A further disadvantage of this system are the relatively large radii to be negotiated in the inclined/horizontal transition zones, the fulcrum being located in the region of the forks outside of the pallet bodies, resulting in inadmissable wide gaps, especially in zones of horizontal/inclined transition and vice-versa.

Furthermore, travelator pallet bodies are typically manufactured by casting such that connecting elements as well as treadplate supporting elements are formed integrally with the treadplates. Although pallet bodies produced in this way are economical, they have the drawback in that large gaps result due to the connecting elements and the treadplate supporting elements being arranged beneath the treadplates. These large gaps materialize particularly in the critical zones of inclined/horizontal transition as smaller radii have the prospect of being used at these locations. Accordingly, it is typical of this prior art that the overall length of the travelator cannot be reduced which ultimately results in increased costs. Due to the connecting elements being open downwards it is furthermore a problem to incorporate the pallet bodies directly in the travelator, thus resulting in increased labor being required for installation.

SUMMARY OF THE INVENTION

The object of the subject matter of the invention is to improve a travelator pallet body as set forth in the first paragraph of the Background of the Invention, on the one hand, permit, with a compact design of the same, direct means of installation (without any further preassembly) of the pallet body in the associated travelator and, on the other, to enable the orbital radii of the transition zones and thus also the overall length of the travelator to be substantially reduced.

This object is achieved in accordance with the invention by the connecting elements being configured as hollow cylinders and the fulcrum is provided between adjacent pallet bodies roughly midway below the end portions of the meshing teeth of individual treadplates.

Due to the connecting lugs and the treadplate supporting elements, in a departure from the prior art, now being provided near to the corners within the side defining edges beneath the treadplates, a system is defined in which the width and length of the travelator overall can be reduced materially. A further advantage is to be appreciated in that a uniform compact pallet for both department store and transportation applications is now provided. The compact pallet in accordance with the invention comprises bifurcated treadplate supporting elements that are cast and integrated beneath the treadplate in conjunction with connecting lugs likewise cast in place. Locating the fulcrum between the individual pallets ultimately achieves smaller (convex) transition arcs in each of the transition zones of the travelator. Cast-in-place pins, as disclosed in prior art, can now be completely eliminated in a travelator in accordance with the invention since separate treadplate supporting elements are no longer needed. The same applies to the now no longer needed preassembly of the pallets, since corresponding components such as rollers, drive chains or the like are now provided for simple insertion mounting.

Another advantage achieved by the invention is due to the shifted fulcrum location which permits lower profiles to be achieved in landing areas by—as viewed in the direction of travel—each rear edge of the pallet no longer veering so far, i.e. moving upwards as would otherwise be the case in prior art, this being of particular advantage in applications in which e.g. shopping carts need to be moved on inclined travelators, in which case an excessively high landing area would cause undesirable jolting.

Furthermore proposed is a method for inspecting and/or repairing a travelator equipped with a plurality of pallet bodies in accordance with the invention, in which only a single pallet body needs to be removed from the track in one of the transition zones of the pallet bodies and the track can run without the pallet body to the inspection or repair point, whereby further pallet bodies can be removed from the track in situ, where necessary. In this arrangement the above steps in the method can then be implemented in the reverse sequence on completion of inspection or repair.

This is made possible by the treadplate supporting elements and the connecting elements being arranged, on the one hand, beneath the treadplate and, on the other, within the side defining edges thereof so that in a departure from prior art no components now protrude beyond the side defining edges. This means that the pallet bodies correspond to the width of the travelator, more particularly the width of the skirting so that once the pallet body has been removed at the inspection or repair point there is no need to first remove skirting parts or such components before further pallet bodies can be removed from the track. Hitherto either a certain number of pallet bodies had to be removed from the transition zones before the track could be run to the point concerned, or the travelator needed to be disassembled in part in situ to enable the repair to be made. By the method in accordance with the invention the time and material needed in inspection and repair can now be considerably reduced as compared to procedures needed hitherto, this ultimately resulting in reduced costs.

BRIEF DESCRIPTION OF THE DRAWING

The subject matter of the invention will now be described by way of an example embodiment with reference to the drawings in which.

DETAILED DESCRIPTION OF THE INVENTION

Figure 1:
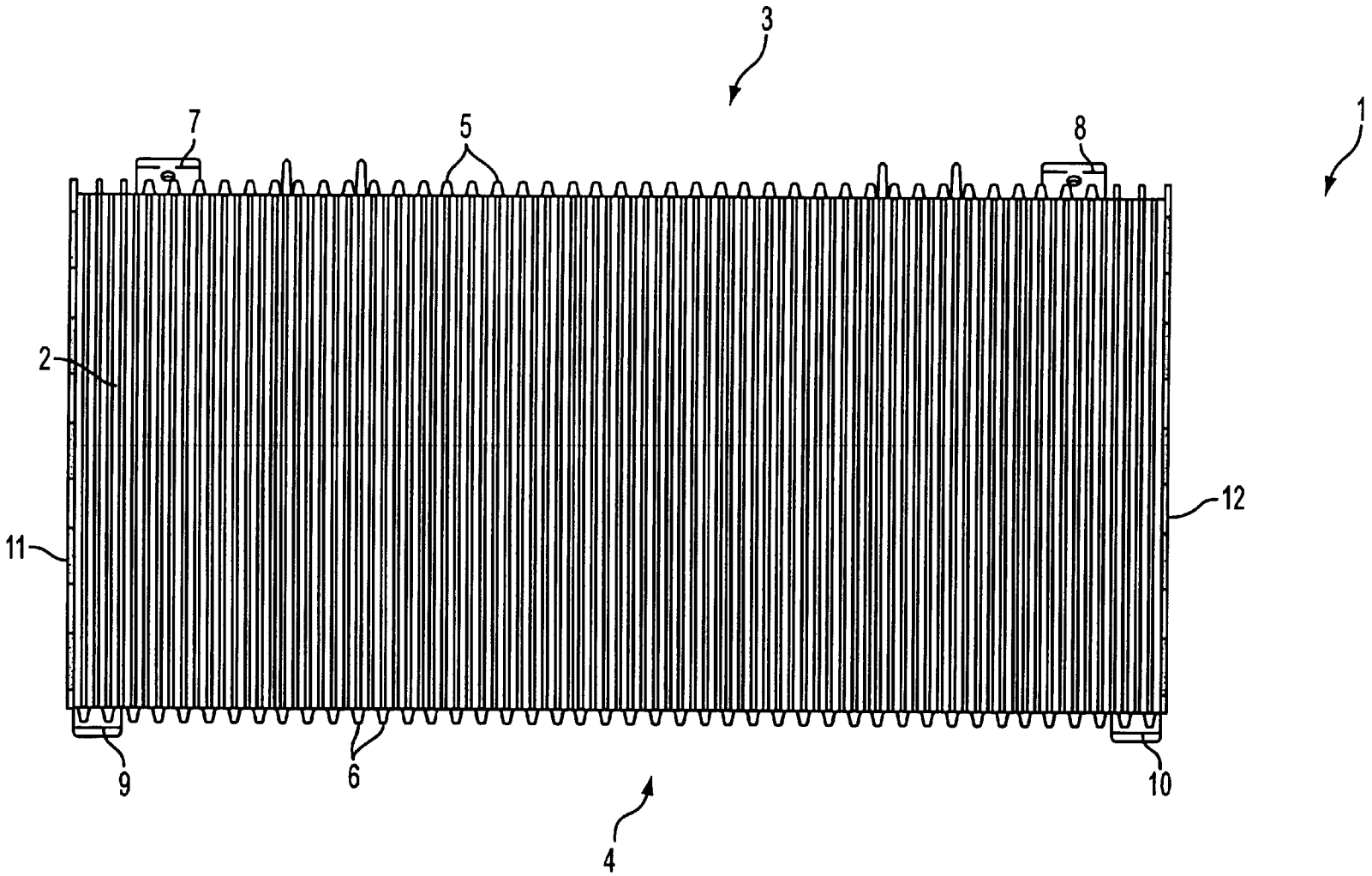
FIG. 1 is a plane view of a pallet body according to the invention.
Figure 2:
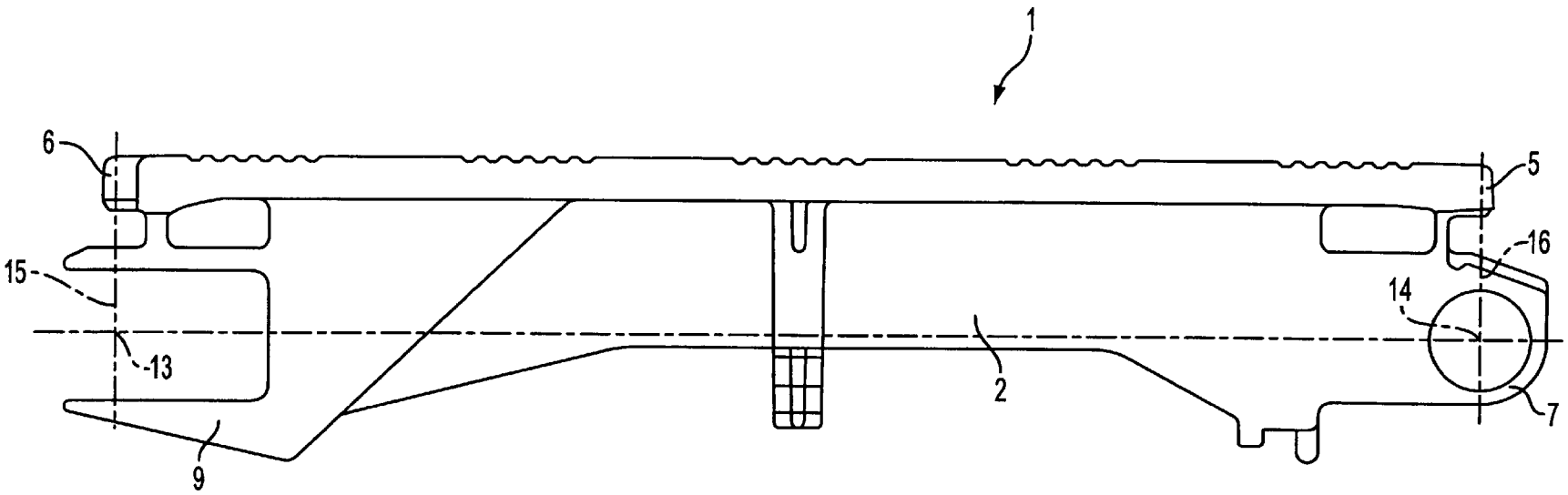
FIG. 2 is a side view of the pallet body according to the invention.

FIGS. 1 and 2 show in various views the pallet body 1 in accordance with the invention, FIG. 1 showing the pallet body 1 as seen from above and FIG. 2 as seen from the side. The pallet body 1 is provided with treadplate 2 ribbed in the transport direction, the treadplate comprising in the region of its front edge 3 as well as in the region of its rear edge 4 a toothing 5 and 6 respectively running over the full length of the pallet body 1. Provided beneath the treadplate 2 are, on the one hand in the region of the rear edge 4, connecting lugs 7,8 and, on the other, in the region of the front edge 3 treadplate supporting elements 9, 10. In this arrangement the connecting lugs 7, 8 serve to receive and guide connecting elements (not shown) in the form of pins or the like, on which rollers and/or traction chains are located (e.g. insertion mounted) while the treadplate supporting elements 9, 10 are configured bifurcated to cooperate with connecting pins of leading or trailing pallet bodies 1. As a rule the pallet bodies 1 are typically made of die-cast aluminum so that the connecting lugs 7, 8 as well as the treadplate supporting elements 9, 10 are cast in place preferably at the locations provided therefor beneath the treadplate 2 near to the corner portions thereof. Both the connecting lugs 7, 8 and the treadplate supporting elements 9, 10 are provided within the side defining edges 11, 12 of the treadplate 2 and protrude merely by a preselected distance beyond the toothings 5, 6 of the front edge 3 and rear edge 4. More particularly evident from FIG. 2 are the front fulcrum 13 and the rear fulcrum 14 provided in the elongation of the imaginary line 15, 16 which parts the leading from the trailing pallet bodies 1 roughly midway to the height of the toothings 5, 6 and located beneath the former.

Figure 3:
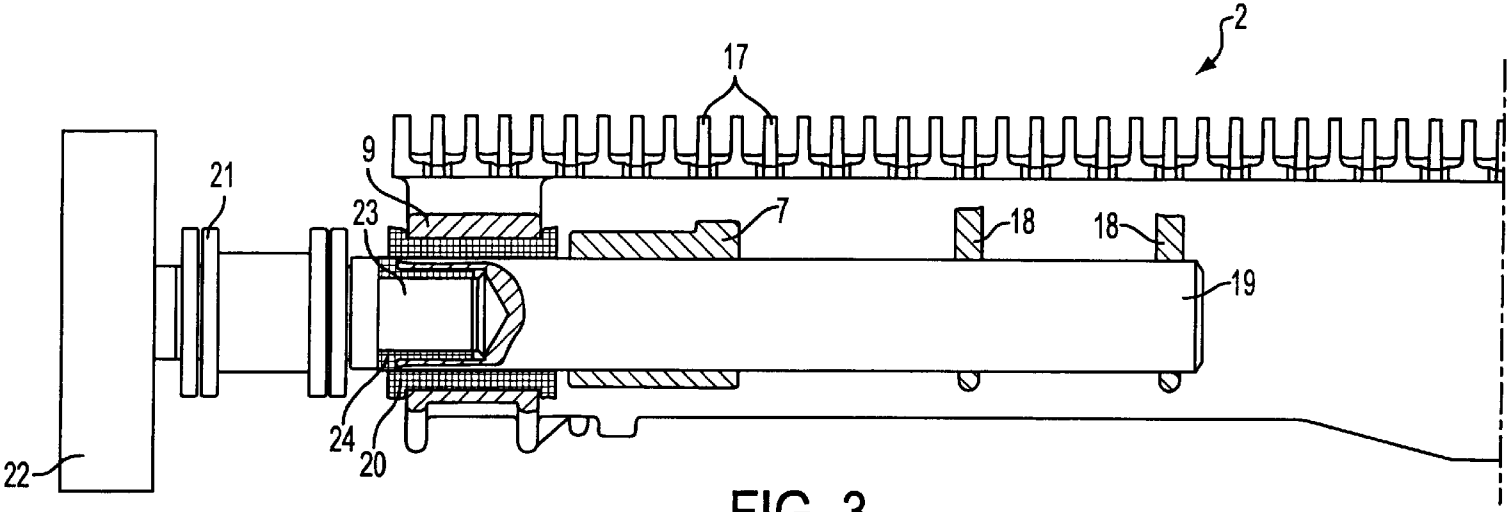
FIG. 3 is a cross-sectional partial view of a pallet body for a travelator.
Figure 4:
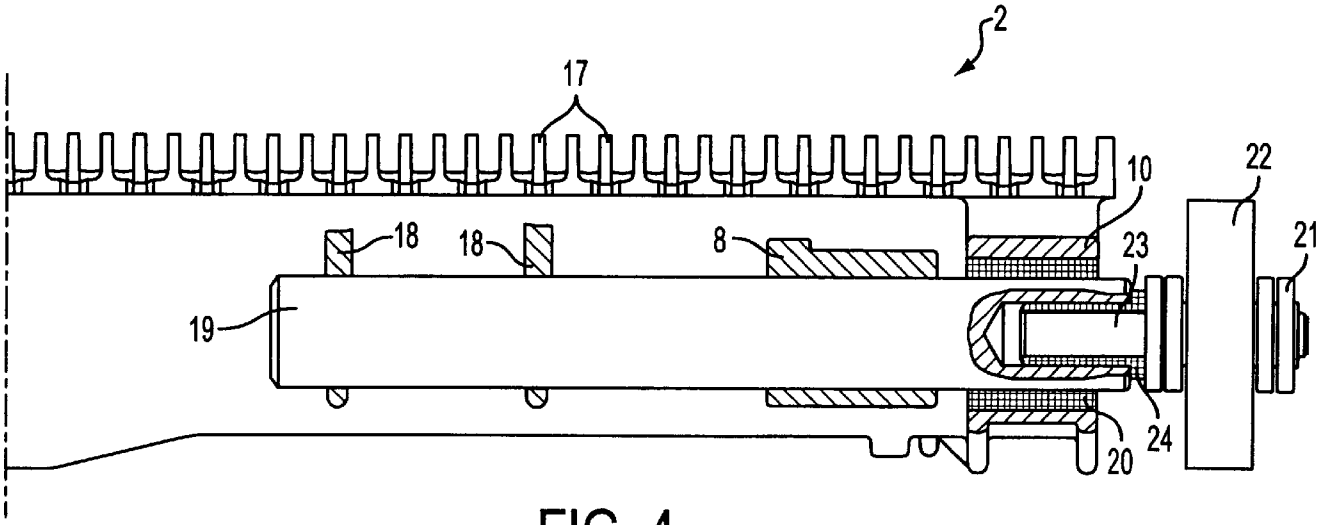
FIG. 4 is a cross-sectional partial view of a pallet body for a travelator.

FIGS. 3 and 4 show example embodiments of a travelator applicable, on the one hand, in a department store and, on the other, in an airport terminal, for example, these FIGS. depicting the following components:

the ribs 17 of the treadplate 2, one of the connecting lugs 7 or 8, one of the treadplate supporting elements 9 or 10 as well as further supports 18 for receiving and guiding a pin-type connecting element 19. In the region of the bifurcated treadplate supporting elements 9 or 10 sliding and guiding elements 20 configured differingly according to the application concerned are provided in the form of sliding blocks. In addition, FIGS. 3 and 4 depict the following components:

a drive member 21 in each case in the form of a link chain, a roller 22, a pin-type element 23 as well as a bush 24 receiving the pin-type element 23 in the facing end portion of the pin 19. In FIG. 4 department store travelator) the rollers 22 are provided between the links of the drive member 21, while in FIG. 3 (transportation travelator) they are disposed laterally adjacent to the links of the drive member 21.

Figure 5:
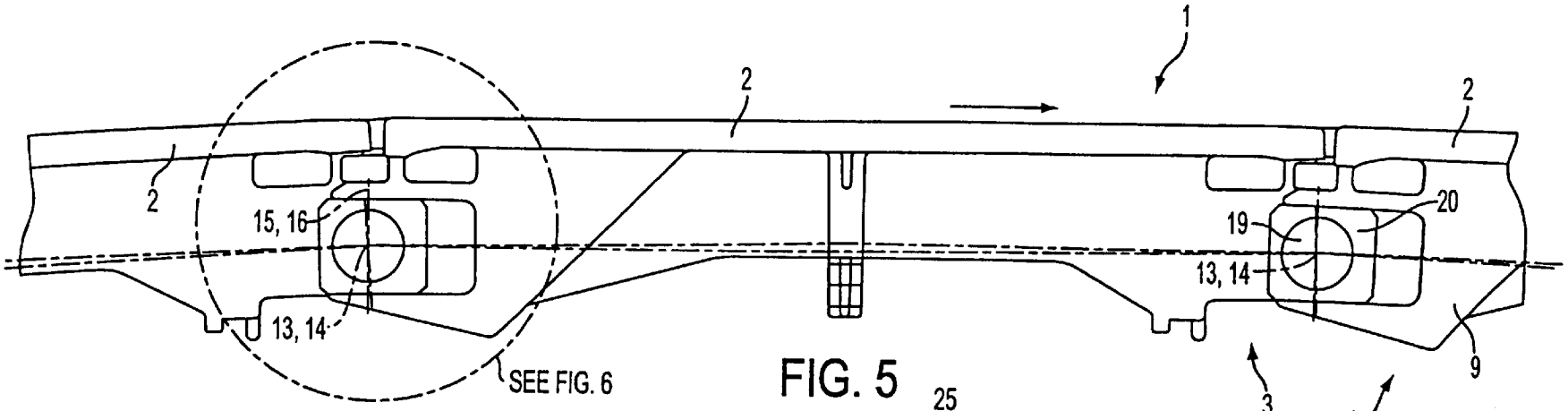
FIG. 5 is a partial view of the upper transition zone of an inclined travelator.

FIG. 5 shows in part a transition zone for the pallet bodies 1 of a travelator system (not shown) in inclined/horizontal transition. The individual pallet bodies 1 are configured substantially the same as shown in FIGS. 1 and 2, and thus like components are identified by like reference numerals. Evident are the ribbed treadplates 2, beneath which—as viewed in the transport direction—in the region of the front edge 3 the connecting lugs 7,8 (not evident in this case) and in the region of the rear edge 4 the treadplate supporting elements 9 are cast in place, as well as the sliding blocks 20. Indicated furthermore are the pins 19. The toothings 5,6 of adjacent pallet bodies 1 mesh typically so that the gap forming between the individual pallet bodies 1 is maintained within acceptable tolerances. Since the connecting lugs 7 and the treadplate supporting elements 9 in the married form of the pallet bodies 1 are located in a single spatial plane the fulcrums 13, 14 are also in line horizontally. In this arrangement the fulcrums 13, 14 are located midway beneath and under the meshing toothings 5, 6 between the individual pallet bodies 1, i.e. in the elongation of the imaginary parting lines 15, 16, as a result of which smaller (convex) transition arcs are possible in the corresponding inclined/horizontal transition zones.

Figure 6:
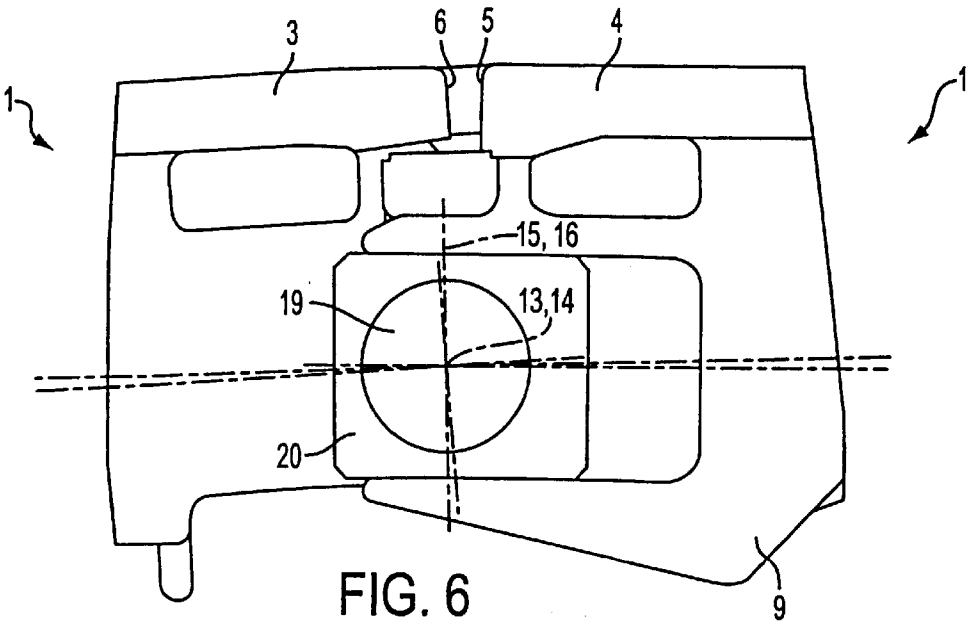
FIG. 6 is a section taken from FIG. 5 showing on a magnified scale the kink portion between two pallets in the transition zone.

FIG. 6 depicts on a magnified scale the zone circumscribed in FIG. 5. The following components are evident in the transition zone 25 between two pallet bodies 1:

the rear portion 4 of the leading pallet body 1, the front portion 3 of the adjoining pallet body 1, a treadplate supporting element 9 together with sliding block 20 and pin 19. The fulcrums 13, 14 are spaced away at a predetermined distance beneath the toothings 5,6 of the two pallet bodies 1, i.e. on the imaginary parting line 15, 16.

Figure 7:
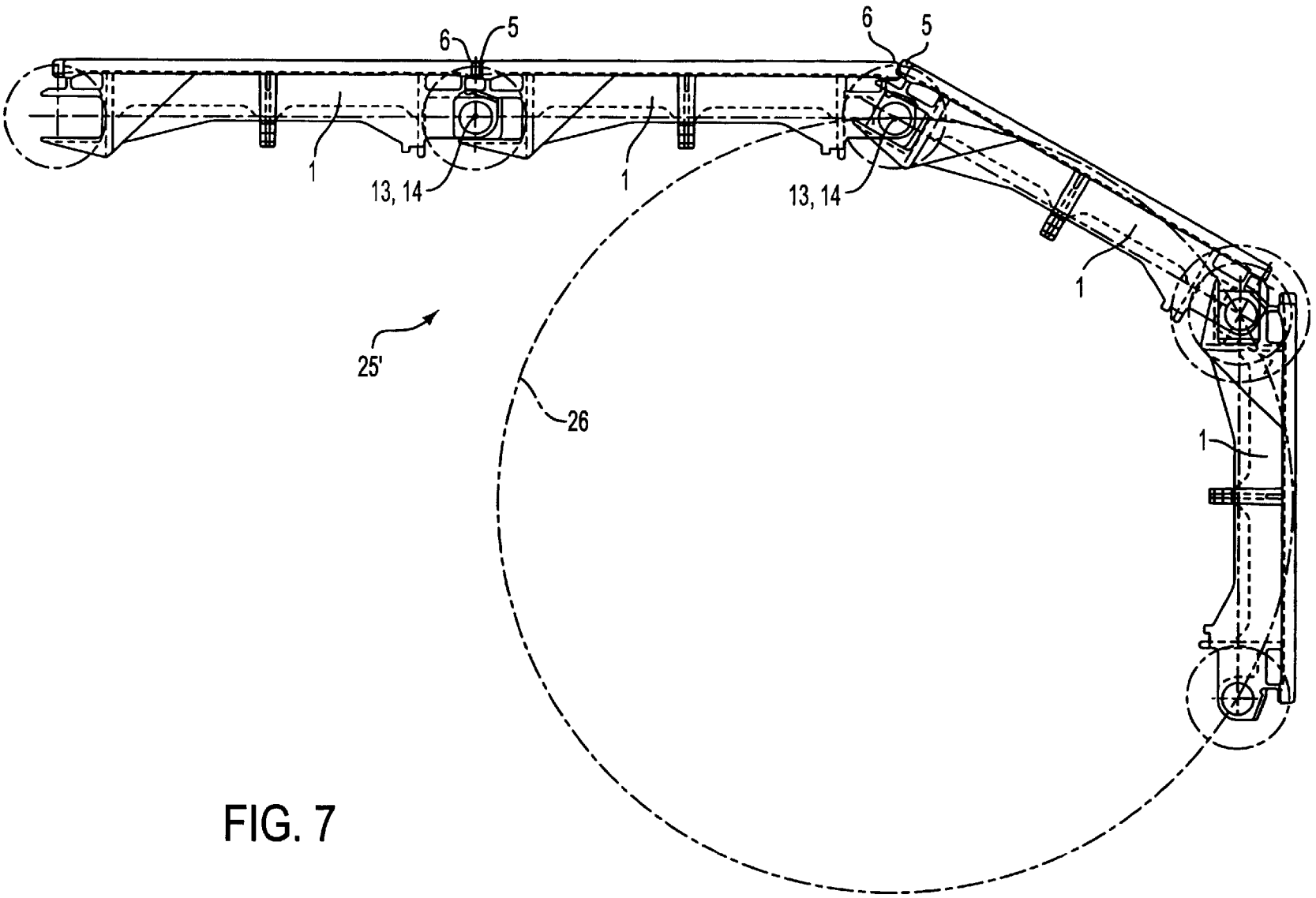
FIG. 7 is a section taken from the upper landing area adjoining the upper transition zone as shown in FIG. 5 including an indication of the upper deflection of the pallet bodies.

FIG. 7 depicts the upper deflection zone 25 adjoining the transition zone 25 as shown in FIG. 5 together with the indicated deflection of the individual pallet bodies 1. Since the individual components of the travelator, more particularly the individual pallet bodies 1, have already been described in sufficient detail with reference to the former FIGS., these are no longer discussed with reference to FIG. 7, the salient criterion thereof being that due to the shift in the location of the fulcrum 13, 14 into the portion beneath the toothings 5, 6 these portions hardly veer upwards in the deflection of the pallet bodies 1 about the (here, merely suggested) sprocket 26.

Figure 8:
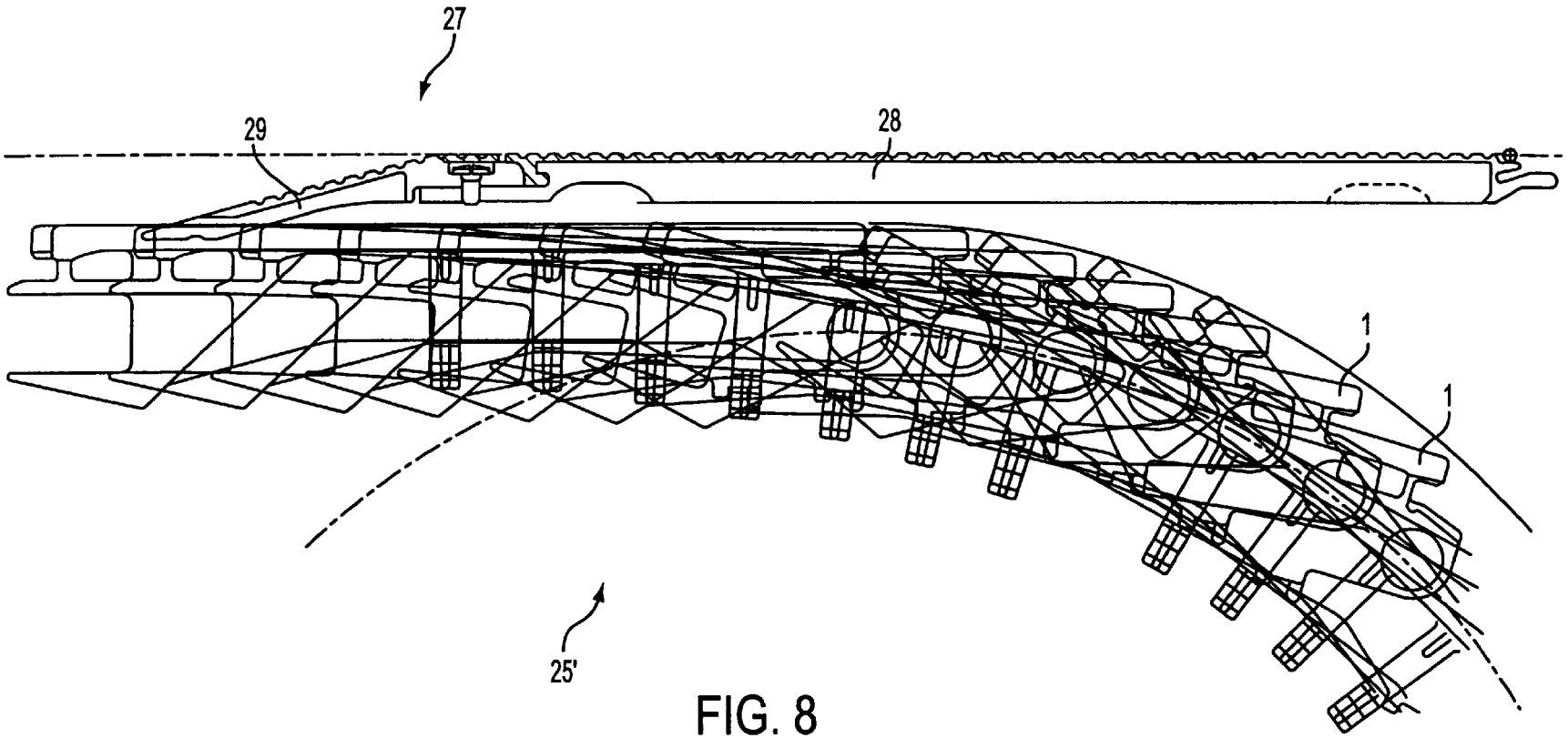
FIG. 8 is a basic illustration of a travelator landing area.

This is particularly evident from FIG. 8 in which the landing area 27, formed by a comb carrier plate 28, is discernible. In this case the individual pallet bodies 1 are merely suggested, it being evident from the curve as shown that the individual pallet bodies 1, more particularly their rear portions, hardly veer upwards. This means that the comb carriers 28 or the combs 29 interacting with the latter as provided in the landing area 27 can be configured with a much lower profile which ultimately is to the benefit of the transition made from the travelator, i.e. from the pallet bodies 1 into the landing area 27, especially in the case of, for instance, shopping carts needing to be negotiated which can then be more easily pushed from the pallet bodies 1 onto the landing area 27.

What is claimed is:

1. A unitary, one-piece pallet body for travelators comprising:

a treadplate having front and rear edges, said front and rear edges having teeth;

connecting elements for receiving and guiding connecting components, said connecting elements having a horizontal axis, said connecting elements extending from and being unitary with said treadplate; and treadplate supporting elements for receiving and guiding leading and trailing pallet bodies in connection with corresponding connecting components, said treadplate supporting elements being arranged underneath, being unitary with, and protruding beyond the rear edge of said treadplate by a specified distance, wherein said connecting elements are configured as hollow cylinders and a fulcrum is provided between adjacent unitary, one-piece pallet bodies roughly midway beneath the end portions of the meshing teeth of the individual treadplates.

2. The pallet body as set forth in claim 1, wherein said fulcrum is provided at the point of intersection of an imaginary parting line with the horizontal axis of said connecting elements, said point of intersection being beneath said meshing teeth of said individual treadplates, said connecting elements joining together with treadplate supporting elements of an adjacent pallet body.

3. The pallet body as set forth in claim 1, wherein, as viewed in a transport direction of said travelator, said connecting elements are configured as connecting lugs and are provided beneath said front edge and said treadplate supporting elements are provided beneath said rear edge.

4. The pallet body as forth in claim 1, wherein said treadplate supporting elements are bifurcated and are approximately level with the side defining edges of said treadplate and near to the corners of said treadplate.

5. The pallet body as set forth in claim 3, wherein said connecting lugs of said pallet bodies are arranged in sequence between said treadplate supporting elements of an adjacent pallet body.

6. A method for inspecting and/or repairing a travelator equipped with a plurality of pallet bodies , each pallet body including a treadplate having front and rear edges, said front and rear edges having teeth; connecting elements for receiving and guiding connecting components, said connecting elements extending from and being unitary with said treadplate, and having a horizontal axis; and treadplate supporting elements for receiving and guiding leading and trailing pallet bodies in connection with corresponding connecting components, said treadplate supporting elements being arranged underneath, being unitary with, and protruding beyond the rear edge of said treadplate by a specified distance, wherein said connecting elements are configured as hollow cylinders and a fulcrum is provided between adjacent unitary, one-piece pallet bodies roughly midway beneath the end portions of the meshing teeth of the individual treadplates, the method comprising the steps of:

removing only a single pallet body from a track in one of a plurality of transition zones of said pallet bodies whereby the track can run without said removed pallet body to the inspection or repair point, removing further pallet bodies from the track in situ, where necessary, and implementing the above steps in reverse sequence on completion of inspection or repair.

7. A unitary, one-piece pallet body for travelators comprising:

a treadplate having front and rear edges, said front and rear edges having teeth;

connecting element means for receiving and guiding connecting components, said connecting element means extending from and being unitary with said treadplate and having a horizontal axis; and treadplate supporting element means for receiving and guiding leading and trailing pallet bodies in connection with corresponding connecting components, said treadplate supporting element means being arranged underneath, being unitary with, and protruding beyond the rear edge of said treadplate by a specified distance, wherein said connecting element means are configured as hollow cylinders and a fulcrum is provided between adjacent unitary, one-piece pallet bodies roughly midway beneath the end portions of the meshing teeth of the individual treadplates.

* * * * *